United States Patent [19]

Maggi

[11] 4,376,069

[45] Mar. 8, 1983

[54] HYDROTROPIC CLEANER AND DEOXIDIZER

[75] Inventor: Richard D. Maggi, Oyster Bay, N.Y.

[73] Assignee: Life Industries Corporation, Old Bethpage, N.Y.

[21] Appl. No.: 343,028

[22] Filed: Jan. 27, 1982

Related U.S. Application Data

[63] Continuation-in-part of Ser. No. 85,003, Oct. 15, 1979, abandoned, which is a continuation-in-part of Ser. No. 937,527, Aug. 28, 1978, abandoned.

[51] Int. Cl.[3] ..... C11D 3/28; C11D 3/10

[52] U.S. Cl. ..... 252/542; 134/40; 252/81; 252/153; 252/171; 252/174.14; 252/174.22

[58] Field of Search ..... 252/174.22, 171, 542, 252/153, DIG. 14, 81, 174.14; 134/22, 38, 40

[56] References Cited

U.S. PATENT DOCUMENTS

| | | | |
|---|---|---|---|
| 2,956,910 | 10/1960 | Giammaria | 134/22 |
| 4,055,515 | 10/1977 | Kirsch | 134/38 X |
| 4,085,059 | 4/1978 | Smith et al. | 252/542 |
| 4,214,915 | 7/1980 | Dillarstone et al. | 134/40 |
| 4,276,186 | 6/1981 | Bakos et al. | 252/158 |

FOREIGN PATENT DOCUMENTS

| | | |
|---|---|---|
| 45-28904 | 9/1970 | Japan . |
| 50-110404 | 8/1975 | Japan . |

*Primary Examiner*—P. E. Willis, Jr.
*Attorney, Agent, or Firm*—DeLio and Libert

[57] ABSTRACT

A cleaner detergent and deoxidizer composition which is particularly suited for removing oil, grease, dust and oxides in a single step operation comprises (a) methyl-2-pyrrolidone, (b) an alkylaryl polyether alcohol obtainable as the reaction product of octylphenol and ethylene oxide and containing an average of five ethylene oxide units per molecule, (d) an alkylaryl polyether alcohol obtainable as the reaction product of octylphenol and ethylene oxide and containing an average of seven to eight ethylene oxide units per molecule and (d) ethylene glycol monobutyl ether. One or more of defoaming and color agents and a fragrance component are included in preferred embodiments of the invention. Sodium bicarbonate may also be included in the composition.

7 Claims, No Drawings

HYDROTROPIC CLEANER AND DEOXIDIZER

CROSS REFERENCE TO RELATED APPLICATIONS

This application is a continuation in part of application Ser. No. 85,003 of Richard D. Maggi for "Hydrotropic, Multipurpose Boat Cleaner and Deoxidizer in an Aqueous Solution", filed Oct. 15, 1979, itself a continuation in part of application Ser. No. 937,527 of Richard D. Maggi for "Hydrotropic Bilge Cleaner", filed Aug. 28, 1978 both abandoned.

BACKGROUND OF THE INVENTION

This invention relates to an improved detergent composition which has the ability to remove, rapidly and completely, oil and grease, dirt, and embedded oxides from fiberglass surfaces, vinyl surfaces, wood painted surfaces, varnish coated surfaces, metallic surfaces such as chrome plated, stainless steel, and aluminum.

The present invention provides a detergent composition possessing excellent detergency and excellent ease of removing oxidation and polymerization products of oils, fats and tars as well as aged films of waxes.

In accordance with the present invention, a treatment technique and composition is available which removes the oxidation expeditiously and restores the surface whether it be fiberglass, metallic, wooden painted or vinyl to a substantially improved appearance and surface without having any deleterious effect on the surface and without creating noxious odors or fumes in the cleaning area.

The pleasure boat segment of the marine industry in particular has witnessed the introduction of new and/or improved materials which are utilized in the construction of both small and large pleasure craft. Each year many adaptations of existing materials necessary for the construction of these vessels are introduced.

The marine environment is perhaps the most severe relative to rapid oxidation of materials used in the construction and maintenance of the present day pleasure boats. The deleterious effect of salt spray, coupled with winds and infra red bombardment cause rapid deterioration of such materials. Without the removal from time to time of oxides or other deterioration products thus formed, continued deterioration of the materials and their ability to perform the functions for which they were designed is unchecked. The oxides, etc. formed by oxidation and other deterioration of these materials can be, by the application of the detergents of this invention, removed to restore the materials to their original, oxide-free condition. The detergent of the invention removes embedded oxides as well as dirt, grime, grease and mildew.

It is an object of the present invention to provide an improved technique for restoring and cleaning of painted metallic surfaces as well as removing oil, grease, grime, dirt and embedded oxides from the material surfaces noted without affecting the original treated surface.

Referring to the present day cleaning and deoxidizing agents, chemicals and detergents which are available, the present invention differs significantly since it is characterized by the fact that it is unusually flexible and multifaceted, being useful for a large variety of materials.

The application of the cleaner of the present invention to such a wide multitude of materials gives it a unique quality as a flexible concentrate which may be used full strength or diluted with either salt or fresh water (salt water being sometimes herein referred to as sea-water).

Cleaning compositions used in the marine industry presently are specialized for use on specific materials to be cleaned; further, they are usually classified as either cleaners or deoxidizers. Some products are available to perform in various areas and serve multipurpose uses; however, none is believed to have the multiplicity of uses of the novel detergent of the present invention.

Known compositions for "cleaning" in the marine industry include compositions of primarily sodium metasilicate together with N-alkyl and dimethyl benzyl ammonium chlorides. They manifest themselves in liquids and pastes and further are generally purported to "clean" a family of materials, but in order to be effective are recommended as one of a two-part system, such as a cleaning and polishing system. In this regard, the polishing operation usually enhances or completes the task sometimes purported to be achieved by the cleaner alone.

The detergent composition of the present invention requires no second step follow-up as the purpose is both to clean and deoxidize.

The composition of this invention generally utilizes a wetting agent, octyls and a solvent base. The composition provides breakdown, miscibility and emulsifying and dispersion effects which afford a synergistic action of the three major components. The ability of the composition to permeate into oily films and waxy compositions permits further emulsification and dispersion of such materials into solution. The preferred range of use of the composition of the invention is from its concentrate formula up to a dilution in water (fresh or salt) of 1 part by weight detergent composition to 28 parts by weight water.

It should be understood that although specific examples of compositions and their mode of application are given herein as intended for use in the pleasure boating marine industry, neither the invention nor the use is so limited. The invention rather provides a useful cleaning and deoxidizing product with excellent stability of the suspension and excellent shelf life.

Generally, the detergent composition of the invention provides a cleaner and deoxidizer which does not adversely affect the surfaces which it cleans and deoxidizes. The detergent of the present invention is capable of removing oxidation, i.e., oxides formed on metal and other surfaces, oil, grease, dirt, and grime from fiberglass, painted surfaces, varnished surfaces, vinyl surfaces, chrome plated metals, porcelain, aluminum, stainless steel, A.B.S. (acrylonitrile-butadiene-styrene copolymer) plastics, polyvinylchloride plastics, polypropylene plastics, nylon, and dacron materials. For example, the detergent of the present invention finds use in cleaning and deoxidizing boat hulls, decks, cabins and headliners, NAVY-type, Bimini-type and camper type tops used on pleasure boating vessels, is useful for removing oil, grease, dirt and grime from nylon and dacron cordage such as dock lines, anchor lines and halyard (sheet) lines, for removing mildew from vinyls, painted surfaces and varnished surfaces and for removing oil, grease, dirt and grime from nylon and dacron sails. The detergent composition finds use as a general purpose cleaner from grime, oxidized or otherwise deteriorated (as by sunlight) paint and dye scale, etc.

SUMMARY OF THE INVENTION

In accordance with the present invention there is provided a detergent composition comprising (a) methyl-2-pyrrolidone; (b) an alkylaryl polyether alcohol obtained as the reaction product of octylphenol and ethylene oxide and containing an average of five ethylene oxide units per molecule; (c) ethylene glycol monobutyl ether and (d) an alkylaryl polyether alcohol obtained as the reaction product of octylphenol and ethylene oxide and containing an average of seven to eight ethylene oxide units per molecule.

In accordance with preferred aspects of the invention, the composition may include one or more of a defoaming agent, a fragrance component and sodium bicarbonate.

In one aspect of the invention, the composition comprises 5.4 to 6.6 parts by weight of methyl-2-pyrrolidone; 30.2 to 37.0 parts by weight of the alkylaryl polyether alcohol containing an average of five ethylene oxide units; 4.5 to 5.5 parts by weight of ethylene glycol monobutyl ether and 20.1 to 24.6 parts by weight of the alkylaryl polyether alcohol containing an average of seven to eight ethylene oxide units. The invention also provides that the cleaning composition may further include water, preferably up to 28 parts by weight of water to one part by weight of the balance of the composition.

A combination of specific nonionic alkylphenyl polyether alcohols with other ingredients as described herein has been found to provide a highly effective cleaning composition. The polyether alcohols, commonly referred to as alkylaryl polyether alcohols, which are used in the present invention can be, and usually are, prepared by the reaction of octylphenol with ethylene oxide. Their structural formula may be represented by

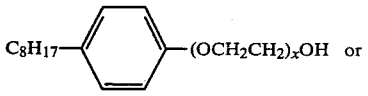

or

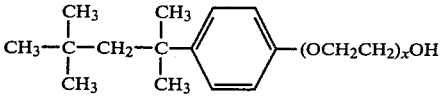

in which formula x is the average number of ethylene oxide units in the ether side chain. Such compounds are commercially available and are known for use in detergent compositions. For example, Rohm and Haas Company of Philadelphia, Pa. sells such compositions under the trademark TRITON. Different grades of the product are commercially available, including one with an average of five ethylene oxide units (TRITON X-45) and seven to eight ethylene oxide units (TRITON X-114). See the Rohm and Haas copyright brochure entitled "TRITON SURFACE-ACTIVE AGENTS—Nonionic Alkylphenyl Polyether Alcohols" (1977).

In accordance with certain aspects of the invention, the two grades of alkylaryl polyether alcohols may be present in equal amounts or the five-average ethylene oxide unit grade may be present in a weight ratio to the seven-to-eight average ethylene oxide unit grade of about 1 to 3:1, preferably 1.5 to 2:1.

As used herein and in the claims, the term "fragrance agent" generally refers to any suitable odorant. To be suitable, the odorant must be one which, in addition to providing a pleasant or desired odor to the composition, one which preferably is persistent enough to linger after the cleaning composition has been rinsed away, the odorant will not substantially adversely interfere with the cleansing, detergent or deoxidizing action of the composition. Many such odorants are well known in the art and are commonly used in household cleaners and the like. Generally, balsamic, pine, and lemon type odorants are preferred.

As used herein and in the claims, the term "defoaming agent" means any suitable substance which is used to reduce foaming tendency of the composition. By "suitable" is meant a defoaming agent which will not substantially adversely interfere with the cleansing, detergent or deoxidizing action of the composition. Such defoaming agents are well known in the art and used in products and processing in a variety of industries. Typical examples are 2-octanol, sulfonated oils, organic phosphates, silicone fluids, dimethylpolysiloxane, etc.

Ethylene glycol monobutyl ether is commercially available, for example, it is sold under the trademark Butyl Cellosolve by Union Carbide Corporation.

Generally, each of the ingredients in the composition is present in an amount at least sufficient to render the ingredient effective. Without wishing to necessarily be bound thereby, it is believed that the methyl-2-pyrrolidone acts as a solvent, the ethylene glycol monobutyl ether acts as an emulsifier and the two alkylaryl polyether alcohols act as wetting agents. The specific combination of alkylaryl polyether alcohols have been found to provide a particularly effective combination when used in conjunction with the other ingredients. The sodium bicarbonate is useful to provide a small (carbon dioxide) positive pressure above the composition when it is packaged in containers such as plastic bottles or jars. Other ingredients which do not adversely substantially affect the cleaning properties of the composts may also be added, e.g., colors.

A preferred embodiment of the invention is exemplified by the following composition.

| pounds | |
|---|---|
| 336 | Liquid - Alkylaryl (octyl phenoxy polyepoxy) polyether alcohol with 5 moles of ethylene oxide. |
| 224 | Liquid - Alkylaryl (octyl phenoxy polyepoxy) polyether alcohol with 7–8 moles of ethylene oxide. |
| 11 | Defoamer - NOPCO NXZ manufactured by Diamond Shamrock Chemical Company |
| 2 | $NaHCO_3$ |
| 60 | Methyl-2-pyrrolidone |
| 50 | Ethylene glycol monobutyl ether - BUTYL CELLOSOLVE manufactured by Union Carbide Corporation |
| 11 | Fragrance Agent - CEDAR FRAGRANCE 6166-Y International Favors, Fragrances, Inc. |
| 5,121 | Water |

The application of this invention is accomplished by wetting a cellulose sponge or terry cloth type toweling with the detergent and applying it in a circular motion upon the material or materials to be cleaned or deoxidized. The detergent is then flushed with water (fresh or salt) and either toweled dry or allowed to air dry.

The alkylaryl polyether alcohols specified for use in the invention may of course be prepared by any suitable technique. Generally, they are in fact obtained by the reaction of octylphenol and ethylene oxide and accordingly are described as "obtainable" by such reaction.

What is claimed is:

1. A detergent composition comprising (a) methyl-2-pyrrolidone; (b) an alkylaryl polyether alcohol obtainable as the reaction product of octylphenol and ethylene oxide and containing an average of five ethylene oxide units per molecule; (c) ethylene glycol monobutyl ether and (d) an alkylaryl polyether alcohol obtainable as the reaction product of octylphenol and ethylene oxide and containing an average of seven to eight ethylene oxide units per molecule.

2. The composition of claim 1 further including water.

3. The composition of claim 1 or claim 2 comprising 5.4 to 6.4 parts by weight of methyl-2-pyrrolidone; 30.2 to 37.0 parts by weight of said alkylaryl polyether alcohol containing an average of five ethylene oxide units; 4.5 to 5.5 parts by weight of ethylene glycol monobutyl ether and 20.1 to 24.6 parts by weight of said alkylaryl polyether alcohol containing an average of seven to eight ethylene oxide units.

4. The composition of claim 1 or claim 2 further including a defoaming agent.

5. The composition of claim 1 or claim 2 further including sodium bicarbonate.

6. The composition of claim 1 or claim 2 further including a fragrance component.

7. The composition of claim 3 including up to 28 parts by weight of water to one part by weight of the balance of said composition.

* * * * *

UNITED STATES PATENT AND TRADEMARK OFFICE

CERTIFICATE OF CORRECTION

PATENT NO. : 4,376,069

DATED : March 8, 1983

INVENTOR(S) : Richard D. Maggi, Oyster Bay, NY

It is certified that error appears in the above-identified patent and that said Letters Patent are hereby corrected as shown below:

Cover page, left column, third line of item [63], replace "937,527" with --937,327--

Column 1, line 10, replace "937,527" with -- 937,327 --

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*